US010183780B2

(12) United States Patent
Mesika

(10) Patent No.: US 10,183,780 B2
(45) Date of Patent: Jan. 22, 2019

(54) CONTAINER FOR HOLDING INVISIBLE ELASTIC BANDS THEREIN

(71) Applicant: Yigal Mesika, Los Angeles, CA (US)

(72) Inventor: Yigal Mesika, Los Angeles, CA (US)

( * ) Notice: Subject to any disclaimer, the term of this patent is extended or adjusted under 35 U.S.C. 154(b) by 467 days.

(21) Appl. No.: 14/860,081

(22) Filed: Sep. 21, 2015

(65) Prior Publication Data

US 2017/0081110 A1 Mar. 23, 2017

(51) Int. Cl.

| | |
|---|---|
| ***B65D 85/02*** | (2006.01) |
| ***B65D 27/00*** | (2006.01) |
| ***A63J 21/00*** | (2006.01) |
| *B65D 25/10* | (2006.01) |

(52) U.S. Cl.

CPC ..... *B65D 27/00* (2013.01); *A63J 21/00* (2013.01); *B65D 25/107* (2013.01)

(58) Field of Classification Search

CPC .. B65D 25/107; B65D 81/2038; B65D 85/16; Y10S 383/903

USPC ..... 206/380, 449, 524.8, 555; 383/100, 105, 383/119, 903

See application file for complete search history.

(56) References Cited

U.S. PATENT DOCUMENTS

| | | | | |
|---|---|---|---|---|
| 231,346 | A | 8/1880 | Neububgeb | |
| 1,441,266 | A * | 1/1923 | Clune | A47G 33/0863 206/410 |
| 2,328,522 | A | 8/1943 | Yocum | |
| 2,519,706 | A | 8/1950 | Ryan | |
| 2,778,173 | A * | 1/1957 | Taunton | B65D 33/01 206/524.8 |
| 3,136,418 | A | 6/1964 | Stacy et al. | |
| 3,224,574 | A * | 12/1965 | McConnell | B65D 33/007 206/389 |
| 3,462,006 | A | 8/1969 | Bernard | |
| 3,869,044 | A | 3/1975 | Olsson et al. | |
| 3,984,047 | A * | 10/1976 | Clayton | B29C 47/0026 206/380 |
| 4,258,843 | A | 3/1981 | Wymer | |
| 4,615,435 | A | 10/1986 | Alpern et al. | |
| 5,197,597 | A | 3/1993 | Leary et al. | |
| 5,277,299 | A | 1/1994 | Holzwarth et al. | |
| 5,390,782 | A | 2/1995 | Sinn | |
| 5,435,438 | A | 7/1995 | Scanlon | |
| 5,584,164 | A * | 12/1996 | Sinn | A61B 17/06138 206/63.3 |

(Continued)

OTHER PUBLICATIONS

U.S. Appl. No. 12/970,887, Non-Final Rejection, dated Jul. 5, 2012.

(Continued)

*Primary Examiner* — Luan K Bui
(74) *Attorney, Agent, or Firm* — Risso I.P.

(57) ABSTRACT

A container for holding invisible elastic bands therein is described. The container includes two opposing walls with a cavity therebetween. A series of raised ridges are formed on the opposing side walls. The raised ridges are formed parallel with one another along each of the opposing walls, thereby allowing a user to insert a sheet within the container such that the invisible elastic bands reside safely between adjacent raised ridges. The container is shaped as an envelope with an unblocked opening and is sized to easily fit within a magician's pocket. Due to its size and shape, the magician can easily retrieve invisible elastic bands during a performance.

5 Claims, 6 Drawing Sheets

(56) References Cited

U.S. PATENT DOCUMENTS

| | | | | |
|---|---|---|---|---|
| 5,662,217 | A | 9/1997 | Durr | |
| 5,690,219 | A | 11/1997 | Harrer | |
| 5,775,504 | A | 7/1998 | Menaged | |
| 5,819,919 | A | 10/1998 | O'Neal | |
| 6,321,907 | B1 * | 11/2001 | Honstrater | B65D 33/00 206/213 |
| 6,779,666 | B2 * | 8/2004 | Collins | B65D 27/00 206/594 |
| 6,799,680 | B2 * | 10/2004 | Mak | B65D 65/406 206/524.8 |
| 7,270,234 | B2 | 9/2007 | Hodsdon | |
| 7,861,861 | B2 | 1/2011 | Mesika | |
| 8,408,394 | B2 | 4/2013 | Mesika | |
| 2006/0177161 | A1 * | 8/2006 | Turvey | B65D 21/08 383/120 |
| 2008/0173559 | A1 | 7/2008 | Senator | |
| 2008/0245790 | A1 * | 10/2008 | Mesika | A45C 11/24 220/9.2 |

OTHER PUBLICATIONS

U.S. Appl. No. 12/970,887, Final Rejection, dated Nov. 20, 2012.
U.S. Appl. No. 12/970,887, Advisory Action, dated Jan. 31, 2013.
U.S. Appl. No. 11/732,679, Non-Final Rejection, dated Mar. 6, 2009.
U.S. Appl. No. 11/732,679, Final Rejection, dated Mar. 9, 2010.
U.S. Appl. No. 11/732,679, Non-Final Rejection, dated Aug. 12, 2010.
Elastic Loop Card, Sold at International Brotherhood of Magicians Convention, 1999.

* cited by examiner

CONTAINER FOR HOLDING INVISIBLE ELASTIC BANDS THEREIN

BACKGROUND OF THE INVENTION (1) Field of Invention

The present invention relates to a container and, more particularly, to a container that is formed to hold a plurality of invisible elastic bands therein.

(2) Description of Related Art

Elastic bands have long been known in the art. By way of example, elastic bands are often considered rubber bands and used to hold items together. For example, rubber bands are typically associated with newspapers, as they hold the newspaper together and prevent it from becoming unraveled.

Expanding upon the rubber band concept, magicians have developed invisible elastic bands that are barely visible and used for magic tricks. An example of such invisible elastic bands are Loops® as sold by Yigal Mesika. Such thin invisible elastic bands allow the magician to perform a variety of tricks while giving the appearance that no invisible elastic band is present. For example, spreading the thin invisible elastic band between two hands allows the magician to suspend an object thereon, while providing the illusion that the object is suspended mid air.

When storing such invisible elastic bands, they are typically placed in a box, purse, or other location that results in the invisible elastic bands becoming bunched up and otherwise disorganized. Additionally, due to the illusory nature of their business, it is desirable for magicians to be able to withdraw the barely visible invisible elastic band without much detection. In the very least, such magicians would need a convenient container to hold the invisible elastic bands in a convenient and organized manner while preventing the invisible elastic bands from being entangled when positioned within the container.

Thus, a continuing need exists for a small and convenient container for holding invisible elastic bands therein. The present invention fulfills such a need.

SUMMARY OF INVENTION

The present invention relates to a container for holding invisible elastic bands therein and, in some embodiments, a sheet having such invisible elastic bands. The container includes two opposing walls with a cavity therebetween. A series of raised ridges are formed on the opposing side walls. The raised ridges are formed parallel with one another along each of the opposing walls, thereby allowing a user to insert a sheet within the container such that the invisible elastic bands reside safely between adjacent raised ridges.

In another aspect, a sheet with notches having a plurality of invisible elastic bands thereon is included, the sheet is positioned within the cavity of the container.

In yet another aspect, the container is approximately 120 millimeters tall by approximately 80 millimeters wide.

In another aspect, the access to the cavity is defined by an unblocked opening.

In another aspect, the raised ridges are formed on the opposing walls such that each raised ridge directly faces another raised ridge on an opposing wall.

In yet another aspect, the raised ridges are formed on the opposing walls such that each raised ridge is offset from another raised ridge on an opposing wall.

Finally, as can be appreciated by one in the art, the present invention also comprises a method for forming and using the container described herein. For example, described is a method for securely storing and retrieving a sheet having invisible elastic bands thereon, comprising an act of positioning a sheet having a plurality of invisible elastic bands within a container, the container having two opposing walls with a cavity therebetween, access to the cavity defined by an unblocked opening, thereby allowing a user to insert the sheet within the container.

In another aspect, wherein in positioning the sheet within the container, the cavity of the container includes a series of raised ridges formed on the opposing walls, thereby allowing a user to insert the sheet within the container such that the invisible elastic bands reside safely between adjacent raised ridges.

In another aspect, the method comprises an act of positioning the container having the sheet therein within a pocket.

In yet another aspect, the method includes an act of retrieving an invisible elastic band from the sheet by squeezing sides of the container to open access to the cavity and the sheet therein.

Additionally, wherein retrieving an invisible elastic band from the sheet further comprises acts of partially withdrawing the sheet from the cavity and removing an invisible elastic band from the sheet.

In yet another aspect, the method includes an act of returning the sheet to the container by squeezing the sides of the container and pressing the sheet into the cavity.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a container and, more particularly, to a container that is formed to hold a plurality of invisible elastic bands therein. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
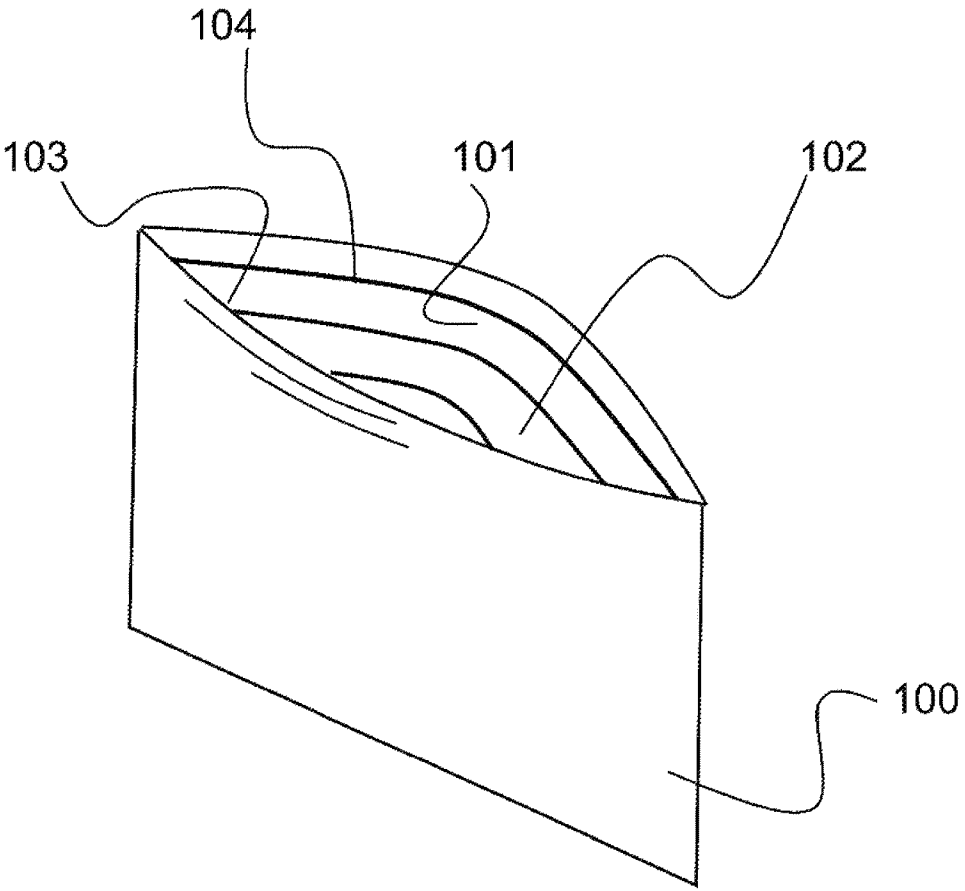
FIG. 1 is an illustration of a container for holding invisible elastic bands according to the principles of the present invention.

The present invention relates to a container for holding invisible elastic bands therein. As shown in FIG. 1, the container 100 has opposing walls 101 and 103 with a cavity 102 therebetween for receiving a sheet or other item therein. In some embodiments, the container 100 can be bent or flexed to open the cavity 100 for insertion of the sheet. As will become evident below, the container 100 is specifically devised to hold a sheet having invisible elastic bands thereon.

The invisible elastic bands are barely visible and used by magicians to perform a variety magic tricks, such as levitating objects, etc. An example of such invisible elastic bands are Loops® as sold by Yigal Mesika, which is an invisible elastic band having a diameter similar to that of human hair. Such thin invisible elastic bands allow the magician to perform a variety of tricks while giving the appearance that no invisible elastic band is present.

In some embodiments, to prevent the invisible elastic bands from becoming entangled with one another, the walls of the cavity 102 optionally include a series of raised ridges 104. The raised ridges 104 provide spaces between the ridges 104 to accommodate the invisible elastic bands. Further, the raised ridges 104 act as barriers to prevent the invisible elastic bands from inadvertently travelling laterally and entangling or otherwise engaging with an adjacent invisible elastic band.

Figures 2A, 2B:
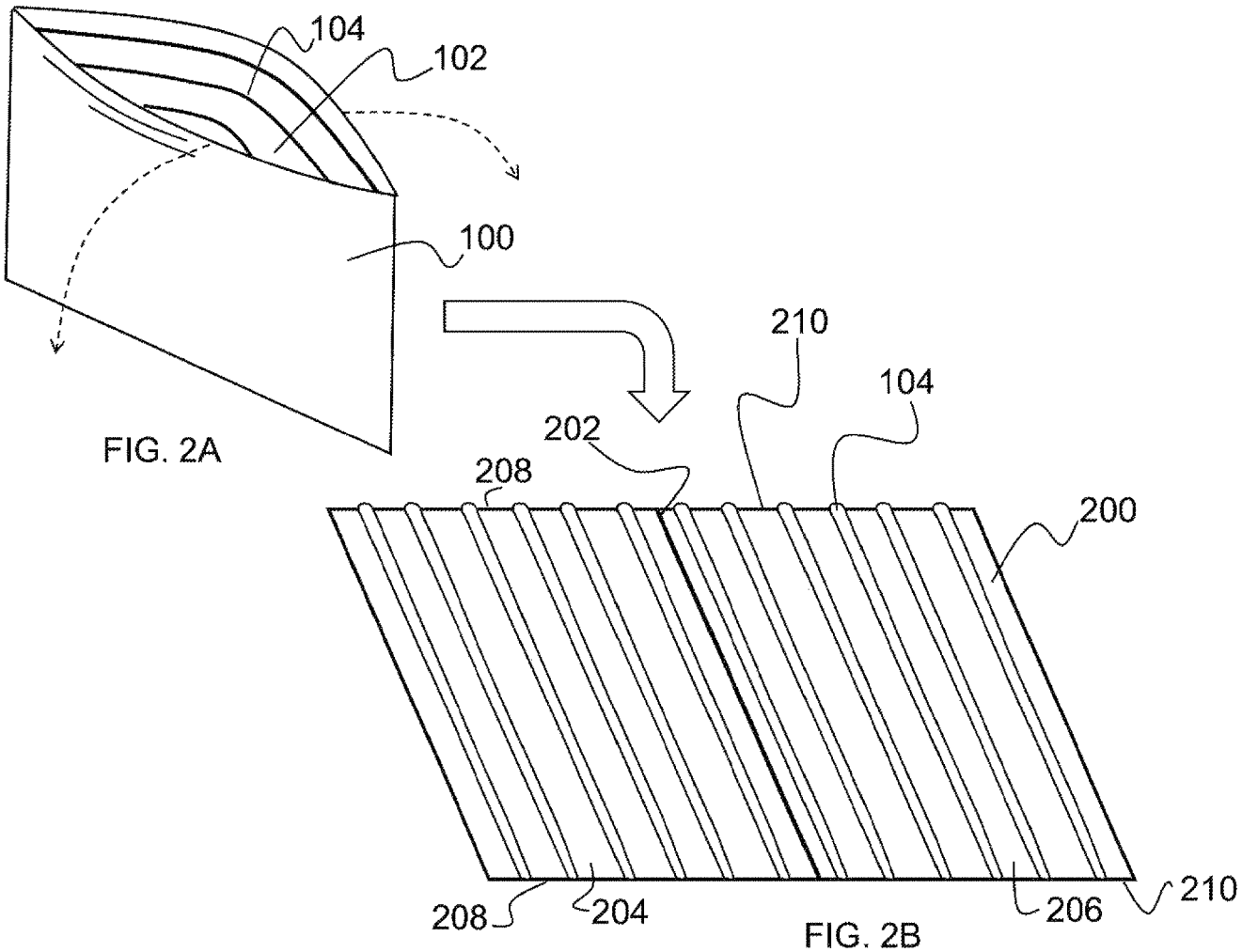
FIG. 2A is an illustration of the container in an open configuration for insertion of a sheet having invisible elastic bands thereon.
FIG. 2B is an internal view illustration of the container, depicting the container split open.

The container 100 is formed of any suitable durable material, non-limiting examples of which include plastic, paper, cardboard, etc. For example and as depicted in FIGS. 2A and 2B, the container 100 can be formed of substantially planar material 200 (e.g., paperboard). FIG. 2A illustrates the container 100 as assembled while FIG. 2B illustrates the container 100 split open to depict its internal components and the raised ridges 104.

The planar material 200 has a first half 204 and a second half 206. In some embodiments, to form the container, the planar material 200 is folded in half 202 to bring the two halves 204 and 206 together. At least two outer edges 208 can 210 can be affixed together to form the container 100 with the cavity 102 therein. The two halves 204 and 206 can be affixed together using any suitable mechanism, technique or device, non-limiting examples of which include glue, clips, staples, etc.

As noted above, the container 100 includes a series of raised ridges 104 within the cavity 102. The raised ridges 104 are formed of any suitable material. As a non-limiting example, the raised ridges 104 are formed of rubber that is adhered to the planar material 200.

Any desired number of raised ridges 104 can be formed. As depicted, for example, six raised ridges 104 are formed on each half 204 and 206 of the planar material 200. In this aspect, a card having five invisible elastic bands thereon would desirably fit within the cavity 102 such that the invisible elastic bands reside between adjacent ridges 104. However and as noted above, any desired number of raised ridges 104 can be formed to accommodate cards with invisible elastic bands of any number. As a non-limiting example, if a card having eight invisible elastic bands were used, the container 100 would desirably be formed to include nine raised ridges 104 on each half 204 and 206 of the planar material 200. Thus, there would exists eight channels between the raised ridges 104 to accommodate the invisible elastic bands.

It should also be noted that the raised ridges 104 can be formed on each half 204 and 206 such that when the planar material is folded in half 202 (or any other suitable folding point to form the container 100), the raised ridges 104 on each half 204 and 206 directly face one another in the cavity (forming the opposing walls of the cavity) and rest against one another when the container is closed, thereby further increasing the channel depth between adjacent ridges 104. Alternatively and in another aspect, the raised ridges 104 can be offset such that they do not directly face each, or any combination thereof.

Figures 3A, 3B, 3C:
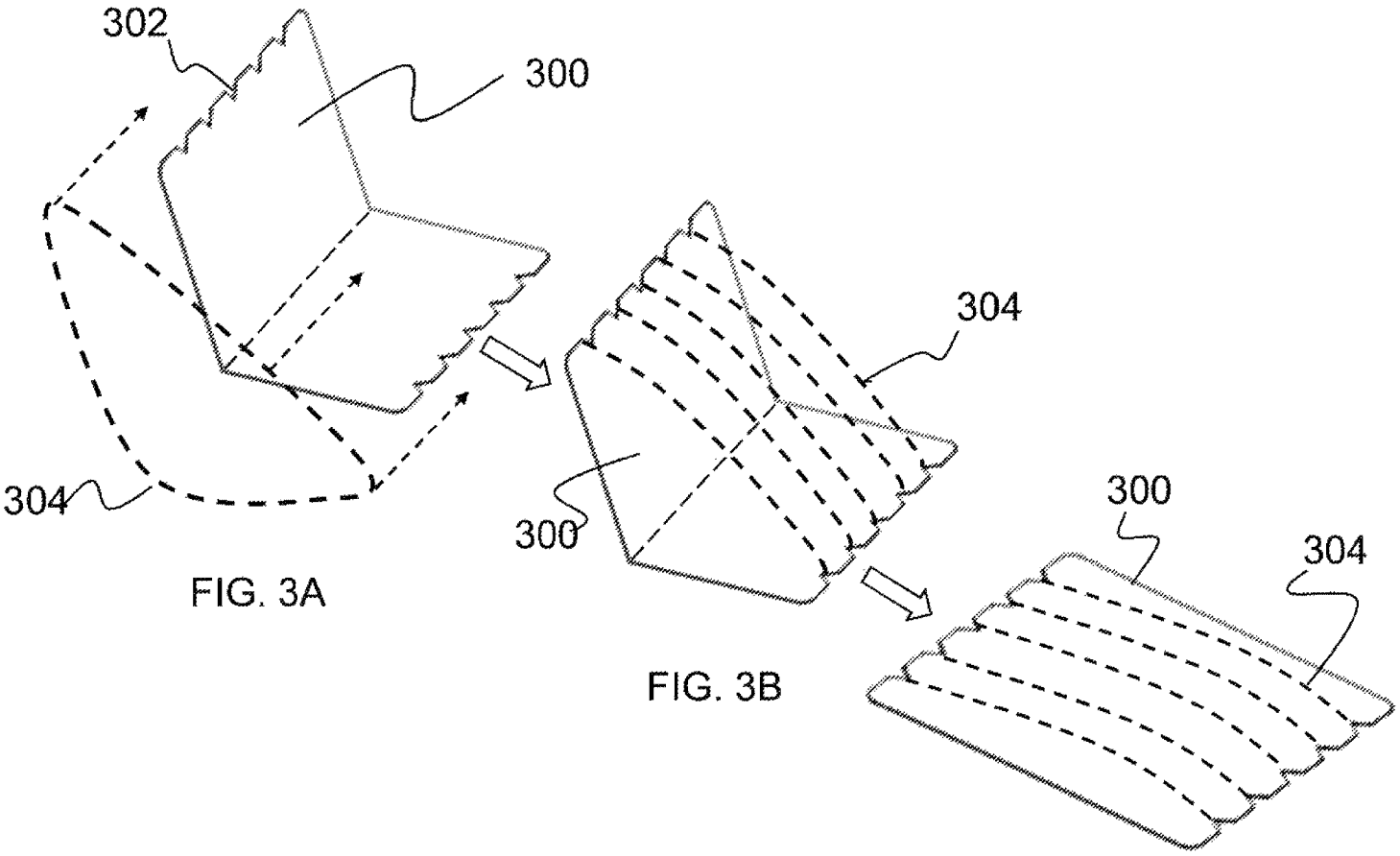
FIG. 3A is an illustration of a sheet for placement of an invisible elastic band thereon.
FIG. 3B is an illustration of the sheet, depicting several invisible elastic bands being positioned around the sheet.
FIG. 3C is an illustration of the sheet, depicting the sheet in a flat configuration for insertion within the container.

As noted above, the container 100 is specifically designed to accommodate a sheet having invisible elastic bands thereon. As a non-limiting example and as depicted in FIGS. 3A through 3C, the sheet 300 includes a plurality of notches 302 to accommodate a plurality of invisible elastic bands 304.

Figure 4:
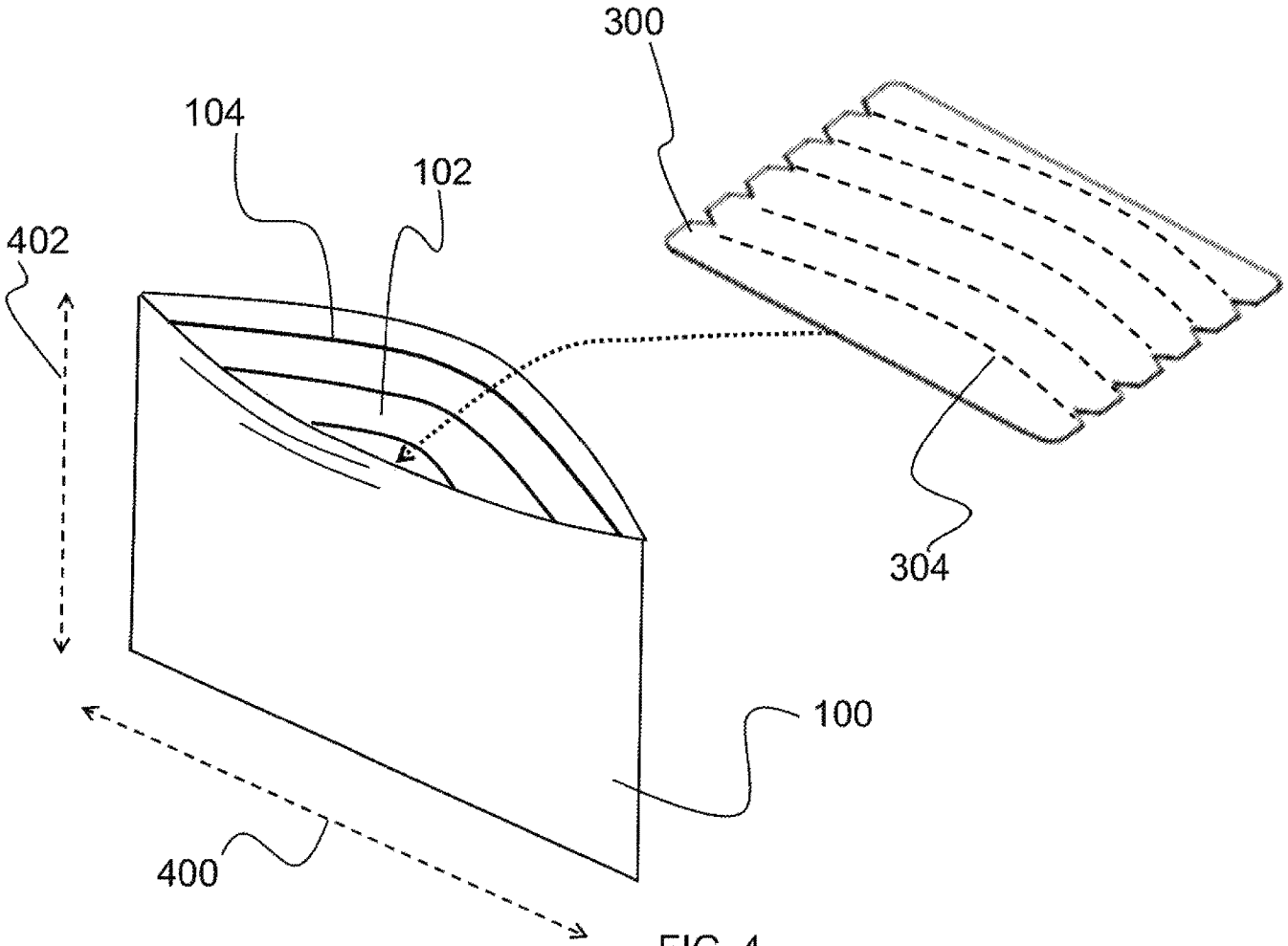
FIG. 4 is an illustration of the container, depicting a sheet being inserted therein.
Figure 5:
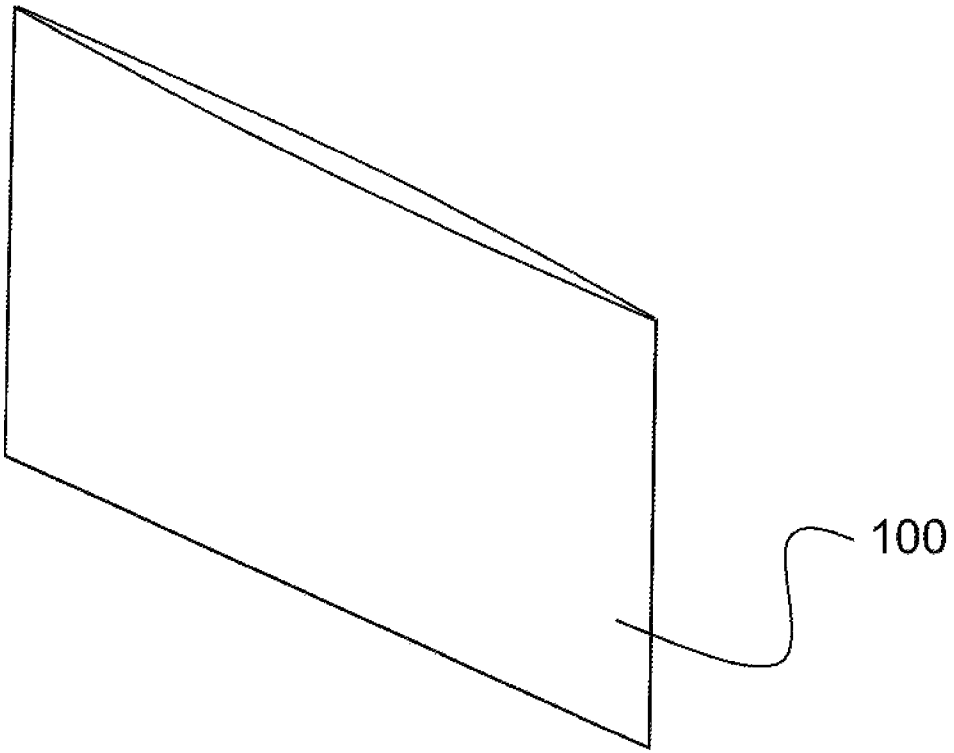
FIG. 5 is an illustration of the container in a closed configuration to contain the sheet therein.

As shown in FIG. 4, the sheet 300 with invisible elastic bands 304 can be positioned within the cavity 102 of the container 100 such that the invisible elastic bands 304 reside between the various raised ridges 104. Finally and as shown in FIG. 5, once positioned within the container 100, the container can be allowed to close to safely contain the sheet 300 and invisible elastic bands 304 therein.

It should be noted that the container 100 can be formed of any suitable size to accommodate invisible elastic bands as typically employed by a magician. As a non-limiting example, the container 100 is sized (e.g., approximately 120 millimeters tall 400 by approximately 80 millimeters wide 402) such that it can fit within a wallet or pocket for easy concealment and transportation.

It should be understood that when performing magic tricks, the invisible elastic bands are very thin and, as a result, can sometimes break. Thus, during such instances, the magician needs to be able to easily and surreptitiously replace the invisible elastic band while performing in front of an audience. Thus, in this aspect, the container 100 needs to be able to be concealed yet still provide for easy access. It is important to note that in some embodiments, the container 100 is specifically formed such that it is pocket sized to easily fit within a pant or coat pocket. Thus, the container 100 is pocket sized (e.g., approximately 120 millimeters tall by approximately 80 millimeters wide, or other pocket sized dimension) and formed as a flapless envelope sleeve so that it can be stored in any pocket, such as a pants pocket or coat pocket. This size imparts a particular functionality in that when the magician is using the invisible elastic bands and if they break, the magician needs backup. Because the container 100 has no cover or flap blocking access to the cavity 102 (i.e., unblocked opening), it allows a magician to easily retrieve an invisible elastic band without much manipulation.

Figure 6:
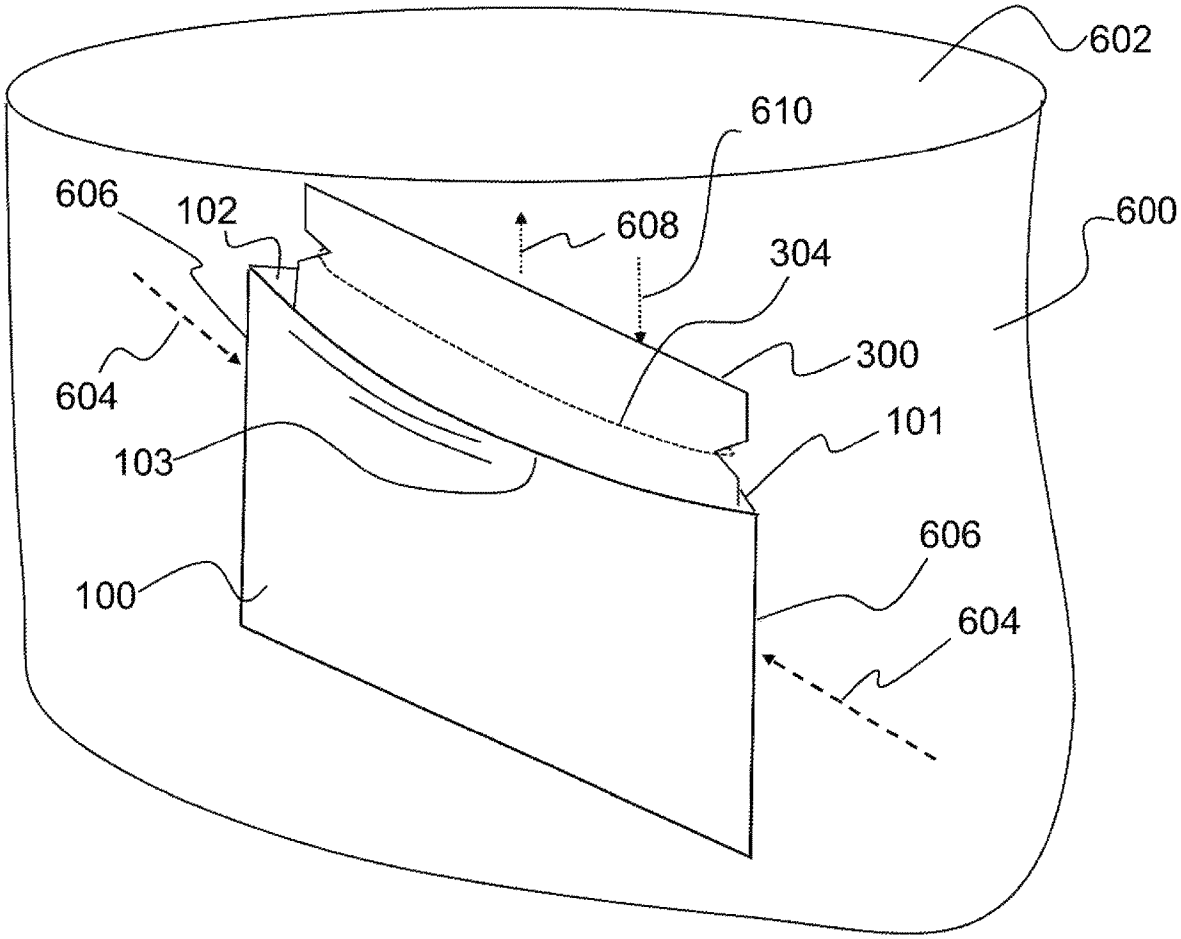
FIG. 6 is an illustration depicting a process for retrieving an invisible elastic band from within the container.

For example and as depicted in FIG. 6, during use the container 100 may be concealed within a pocket 600 (e.g., pant or coat pocket). A user can access the container 100 through the pocket opening 602. By squeezing 604 on the sides 606 of the container 100, the opposing walls 101 and 103 separate to provide easy access to the cavity 102 and sheet 300. A user can obtain an invisible elastic band 304 by simply slipping a thumb or other finger around such an invisible elastic band 304 to retrieve the item. As another example, the user can slide 608 the sheet 300 out partially to provide easy access to an invisible elastic band 304. After slipping a finger under the invisible elastic band 304 to retrieve the item, the sheet 300 can then be easily slid back into (i.e., returned) the container 100 (by squeezing 604 the sides 606 and pressing 610 the sheet 300 into the cavity 102) to protect the remaining invisible elastic bands 304. By withdrawing the hand from the pocket 600, the user has surreptitiously retrieved an invisible elastic band 304. It should be understood that if a different container were to be used, such as a standard envelope, such an envelope inevitably includes a flap or other covering that makes it increasingly difficult to retrieve the invisible elastic band 304. Thus, because the container 100 is pockets sized with no flap or covering, and because it can be squeezed to open the container 100 and provide access to the cavity 102 and sheet 300, a magician to easily retrieve an invisible elastic band 304 without much manipulation.

Thus, the container with invisible elastic bands therein allows the magician to access an invisible elastic band quickly in the middle of a performance.

What is claimed is:

1. A container for holding invisible elastic bands therein, comprising:

two opposing walls with a cavity therebetween, wherein access to the cavity is defined by an unblocked opening;

a series of raised ridges formed on the opposing walls such that the series of raised ridges are substantially parallel with the unblocked opening, thereby allowing a user to insert a sheet within the container such that the invisible bands reside safely between adjacent raised ridges; and wherein the two opposing walls are formed of a substantially planar material and the series of raised ridges are adhered to the substantially planar material;

wherein the raised ridges are formed parallel with one another along each of the opposing walls; and comprising a sheet with notches having a plurality of invisible elastic bands thereon, the sheet positioned within the cavity, of the container.

2. The container as set forth in claim 1, wherein the container is approximately 120 millimeters tall by approximately 80 millimeters wide.

3. The container as set forth in claim 2, wherein the raised ridges are formed on the opposing walls such that each raised ridge directly faces another raised ridge on an opposing wall.

4. The container as set forth in claim 2, wherein the raised ridges are formed on the opposing walls such that each raised ridge is offset from another raised ridge on an opposing wall.

5. A container for holding invisible elastic bands therein, comprising:

two opposing walls with a cavity therebetween, access to the cavity defined by an unblocked opening;

a series of raised ridges formed on the opposing walls such that the series of raised ridges are substantially parallel with the unblocked, opening;

a sheet with notches having a plurality of invisible elastic bands thereon, the sheet positioned within the cavity of the container; and wherein the container is, approximately 120 millimeters tall by approximately 80 millimeters wide, thereby allowing a user to insert the sheet within the container and conceal the container within a pocket of the user.

* * * * *